US005950469A

United States Patent [19]

Tsuro et al.

[11] Patent Number: 5,950,469

[45] Date of Patent: Sep. 14, 1999

[54] METHOD AND EQUIPMENT FOR SURFACE-HARDENING TREATMENT OF STEEL BALLS FOR A BALL BEARING

[75] Inventors: Toshinori Tsuro, Kashihara; Tatsuo Iwai; Isao Fujiwara, both of Nara-ken, all of Japan

[73] Assignee: Tsubaki Nakashima Co., Ltd., Hyogo-ken, Japan

[21] Appl. No.: 09/054,674

[22] Filed: Apr. 3, 1998

[30] Foreign Application Priority Data

Jul. 1, 1997 [JP] Japan ..... 9-188897

[51] Int. Cl.[6] ..... B24C 1/10; B21D 31/00

[52] U.S. Cl. ..... 72/53; 29/1.22; 29/898.069

[58] Field of Search ..... 72/53; 29/1.22, 29/898.069

[56] References Cited

U.S. PATENT DOCUMENTS

| | | | |
|---|---|---|---|
| 2,946,115 | 7/1960 | Firm | 29/1.22 |
| 3,204,320 | 9/1965 | Eckstein et al. | 29/898.069 |
| 3,316,748 | 5/1967 | Lang et al. | 29/898.069 |
| 4,067,240 | 1/1978 | Straub | 72/53 |
| 4,773,244 | 9/1988 | Honda et al. | 72/53 |

FOREIGN PATENT DOCUMENTS

| | | |
|---|---|---|
| 1-12813 | 3/1989 | Japan . |
| 5-195069 | 8/1993 | Japan . |

*Primary Examiner*—David Jones
*Attorney, Agent, or Firm*—Fish & Richardson P.C.

[57] ABSTRACT

An apparatus for surface-hardening steel balls includes a container having projections protruding inwardly from and extending longitudinally along an inner wall; a support shaft having projections extending outwardly from and longitudinally along the support shaft; a container driving mechanism which rotates the container in one direction; and a support shaft driving mechanism which rotates the support shaft in an opposite direction. In operation, the container's projections transfer the balls from a lower portion of the container to a higher portion where the balls are dropped to the lower portion while the support shaft's projections strike the steel balls when the steel balls are dropping to the lower portion.

22 Claims, 8 Drawing Sheets

METHOD AND EQUIPMENT FOR SURFACE-HARDENING TREATMENT OF STEEL BALLS FOR A BALL BEARING

BACKGROUND OF THE INVENTION

1. Field of the Invention

The present invention relates to a method and apparatus for surface-hardening steel balls produced of hardened steel.

2. Description of the Related Art

Japanese Patent Laid-Open Application No. 195069/1993 describes approaches for surface hardening steel balls (e.g. after quenching and tempering) used as bearing balls which are produced of a high carbon chromium bearing steel (JIS G4805) represented by SUJ2 or a martensitic stainless steel (JIS G4303) represented by SUS440C. The surface hardened steel balls have a surface layer with greater residual compressive stress and hardness than untreated steel balls.

Referring to FIG. 8, Japanese Patent Publication No. 12813/1989 describes steel balls 101 charged into a regular octagonal steel barrel 100 through a port 103 to, at most, about two-thirds the inside capacity of barrel 100. The barrel 100 is rotated in the direction of arrow P about a center axis 104 supported on a frame 102. Upon rotating barrel 100, the steel balls 101 move upwardly, and subsequently fall in the direction of arrow Q. The falling steel balls strike against the steel balls 101 lying below and against the inner wall of barrel 100. By continuously repeating this operation, the entire surface of the steel balls 101 are surface hardened. The finished-steel balls are discharged through port 103.

The method described above, however, has the following disadvantages:

(1) If the barrel rotates at an excessively high speed, the steel balls are held against the inner wall of the barrel by a centrifugal force, and thus will not strike against the inner wall. Therefore, it becomes necessary to decrease the revolution number of the barrel to 80 rpm or lower.

At this lower speed, the frequency at which the steel balls strike against each other or against the inner wall is less, such that a longer time is needed to achieve a desired surface residual compressive stress and hardness.

(2) The smaller the diameter of the steel ball, the smaller the striking force per unit time. For example, in the case of a 25 mm steel ball, the net weight of the ball is 0.62 N (63.57 gf), whereas in the case of a 3 mm steel ball, the net weight of the ball is 0.001 N (0.11 gf).

Since the revolution number of the barrel is limited for the reason described above (1), a much longer time is required for surface-hardening small-diameter, e.g., 3 mm steel balls.

(3) To surface harden 3 mm diameter steel balls in a predetermined time, it is necessary to increase the height from which the steel ball is dropped. This, however, requires a larger size barrel, and correspondingly a larger size surface-hardening apparatus, resulting in a lower operation performance.

Consequently it is extremely difficult to surface harden very small steels balls measuring 1 to 3 mm in diameter.

(4) Recently, steel balls for ball bearings used in e.g., automotive transmissions are required to have a long service life and to remain usable even if foreign substances become introduced in the lubricating oil. The steel balls employed for such service must have a greater residual compressive stress and hardness in the surface layer.

To produce steels balls (particularly those of smaller diameter) having surfaces with the required residual compressive stress and hardness, it becomes necessary to increase the barrel size and/or to prolong the treatment time.

SUMMARY OF THE INVENTION

In a general aspect of the invention, an apparatus for surface-hardening steel balls includes a container having projections protruding inwardly from and extending longitudinally along an inner wall; a support shaft having projections extending outwardly from and longitudinally along the support shaft; a container driving mechanism which rotates the container in one direction; and a support shaft driving mechanism which rotates the support shaft in an opposite direction. In operation, the container's projections transfer the balls from a lower portion of the container to a higher portion where the balls are dropped to the lower portion while the support shaft's projections strike the steel balls when the steel balls are dropping to the lower portion. Related aspects of the invention include the apparatus itself and a method of surface-hardening steel balls.

Among other advantages, both the projections on the container and those on the support shaft cause the steel balls to strike against each other and against the inner wall of the container with a greater frequency, as compared with containers and support shafts that do not have projections. Also, the projections on the container agitate the steel balls. Consequently, the treatment time to produce steel balls having a surface layer with a desired residual compressive stress and hardness is reduced. Moreover, the force at which the steel balls are struck by the projections of the support shaft can be adjusted by changing the revolution number of support shaft and its projections. This enables the precise control of the amount of compressive stress produced in the surface layer of the steel balls.

Embodiments of the above aspects of the invention may include one or more of the following features. The container may be a cylindrical barrel that includes projections protruding radially inwardly from its inner wall.

The support shaft can be configured to rotate at a revolution number greater than 1.5 times that of the container. Each of the projections on the support shaft may have a steel ball striking region that is hardened by quenching. The striking region may be an additional attachment affixed to each of the support shaft's projections to lower the costs of production since it may be more cost effective to surface-harden the attachment rather than the projection itself. There can be three equally spaced projections on the support shaft, and the projections can be shaped as flat blades. The container may include six equally spaced projections. The method of surface-hardening steel balls may include stopping the rotation of the container and the support shaft after surface hardening of the steel balls is finished.

All the above aspects provide substantial advantages for a wide variety of applications, including those employed in the automotive and aerospace industries.

Other features and advantages will become apparent from the following description and from the claims.

DESCRIPTION OF THE PREFERRED EMBODIMENTS

Figure 1:
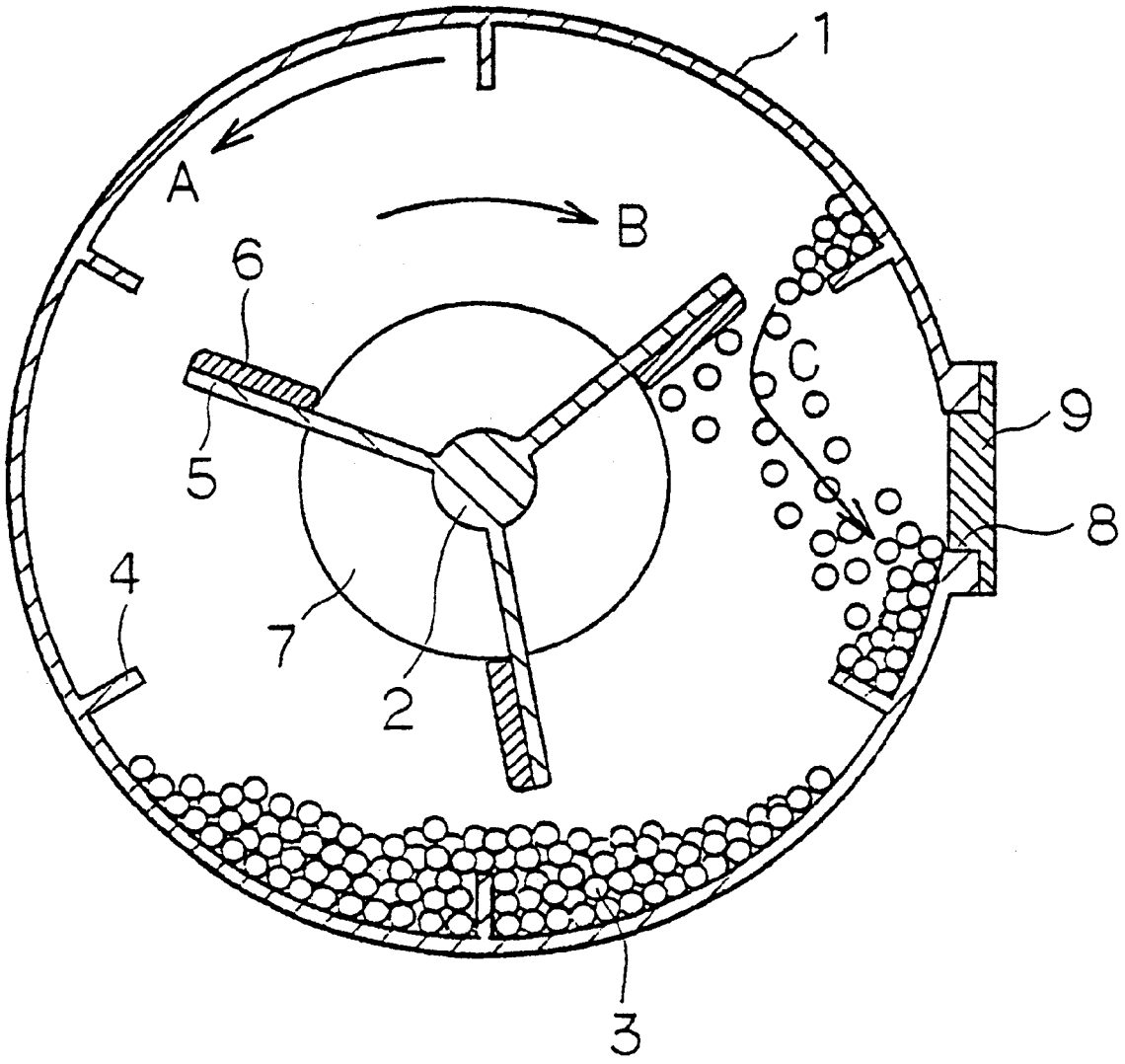
FIG. 1 is a cross-sectional view of a cylindrical barrel.
Figure 2:
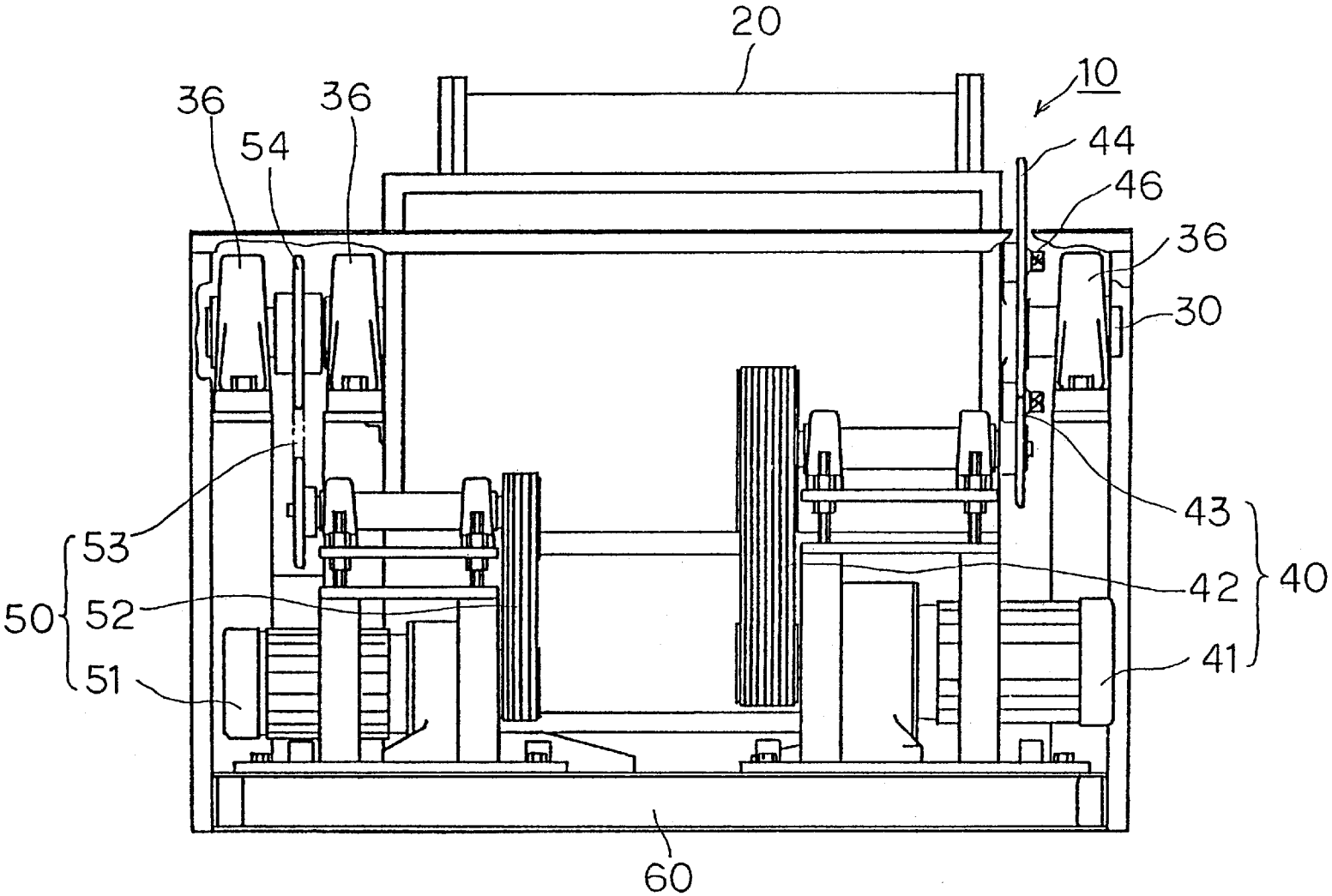
FIG. 2 is a front view of a surface-hardening apparatus for 3 to 17 mm diameter steel balls.

Referring to FIG. 1, a cylindrical barrel 1 includes six projections 4 equally spaced around an inner wall of the barrel and each extending from the inner wall in a direction parallel to the longitudinal axis of the barrel. Barrel 1 also includes a port 8 for charging and discharging steel balls 3, and a cover 9 removably attached to port 8. A support shaft 2 is coaxially mounted in the cylindrical barrel 1. Support shaft 2 includes three flat blades 5 extending in the longitudinal direction within the cylindrical barrel 1, the blades being equally spaced around the support shaft 2 and reinforced with a plate 7. Each blade 5 includes a fixedly attached surface hardened beating (or striking) section 6 for beating steel balls 3, the beating section 6 having a surface hardened by quenching. Projections 4 and blades 5 are arranged so that a predetermined space exists between the projections and the blades. Furthermore, the longitudinal ends of blades 5 are spaced from the end walls (not shown) of the cylindrical barrel. In alternate embodiments, support shaft projections shaped differently than flat blades 5 may be used. Also, non-cylindrically shaped containers may be used in place of cylindrical barrel 1.

In operation, steel balls 3 of hardened steel are charged in the lower part of cylindrical barrel 1 to about one-third or less the inside capacity of cylindrical barrel 1. As cylindrical barrel 1 rotates in the direction of arrow A, projections 4 carry steel balls 3 from the lower part of barrel 1 until the balls reach a point where they are dropped back into the lower part of barrel 1. During rotation of the cylindrical barrel 1, the steel balls 1 are constantly agitated by the projections 4 in the lower part. Simultaneously, support shaft 2 with blades 5 rotate in a direction (designated by arrow B) opposite that of barrel 1 and at a revolution number 1.5 times (or higher) than that of barrel 1. Steel balls 3 dropping from projections 4 are struck by beating sections 6 of blades 5, and thus scattered in the direction of arrow C while also being struck against other steel balls 3 moving in the C direction and/or against the inner wall of cylindrical barrel 1.

Rotation of barrel 1 and support shaft 2 is continued until the entire surface of each steel ball 3 acquires a specific residual compressive stress and hardness as desired.

The number and position of blades 5 and projections 4 were determined experimentally and the arrangement of the three equally spaced blades 5 on the support shaft 2 and the six equally spaced projections 4 on the inner wall of the cylindrical barrel 1 has been found to be a presently most preferred embodiment.

FIGS. 2 to 5 illustrate a surface-hardening apparatus 10 applied to 3 to 17 mm diameter steel balls.

The surface-hardening apparatus 10 includes a cylindrical barrel 20, a support shaft 30 supporting the cylindrical barrel 20, a cylindrical barrel driving mechanism 40 for rotating the barrel in one direction, and a support shaft driving mechanism 50 for rotating the shaft in a direction opposite that of cylindrical barrel 20.

Cylindrical barrel 20 is assembled by tightening a side plate 22 by bolts 23 to a hollow cylindrical body 21. Cylindrical body 21 has an outer diameter of about 1200 mm, a 16 mm wall thickness, and a width of 1300 mm. On the inner wall of hollow cylindrical body 21 are six projections 24 equally spaced around the circumference of body 21, and extending in the longitudinal direction. The cylindrical barrel 20 is supported on the support shaft 30 through the pillow blocks 26. The hollow cylindrical body 21 includes a steel ball charge-discharge port (not shown).

Support shaft 30 is supported on a frame 60 by pillow blocks 36. On the outer periphery of support shaft 30 are three equally space flat blades 32, extending in the longitudinal direction within cylindrical barrel 20. Affixed to each blade 32, by bolts 35, is a hardened beating section 34 for beating steel balls. Blades 32 are spaced from projections 24 as they pass by a distance of about 100 mm and are spaced from side plate 22 by a distance of about 40 mm. A plate 33 mechanically reinforces blades 32.

The cylindrical barrel driving mechanism 40 includes an electric motor 41, a belt power transmission section 42, and a roller chain power transmission section 43 that includes a sprocket 44 which is fastened to the pillow block 26 and the cylindrical barrel 20 by bolts 46.

Support shaft driving mechanism 50 includes an electric motor 51, a belt power transmission section 52, and a roller chain power transmission section 53, including a sprocket 54 mounted on support shaft 30.

Belt power transmission mechanism 42 and the roller chain power transmission mechanism 43 are provided as examples of power transmission mechanisms. However, the present invention is not limited to these types of mechanisms, for example, gears or wire ropes may be used for the same purpose.

The operation of surface hardening apparatus 10 will now be described. After a predetermined quantity of quenched and tempered steel balls are charged through the steel ball charge-discharge port into cylindrical barrel 20, the steel ball charge-discharge port is closed. Cylindrical barrel 20 and support shaft 30 are then rotated at a specified revolution number in the directions indicated by arrows D and E, respectively. An outer ring 28*a* of a ball bearing 28 installed in each pillow block 26 rotates in the D direction, while an inner ring 28*b* rotates in the E direction.

Figure 3:
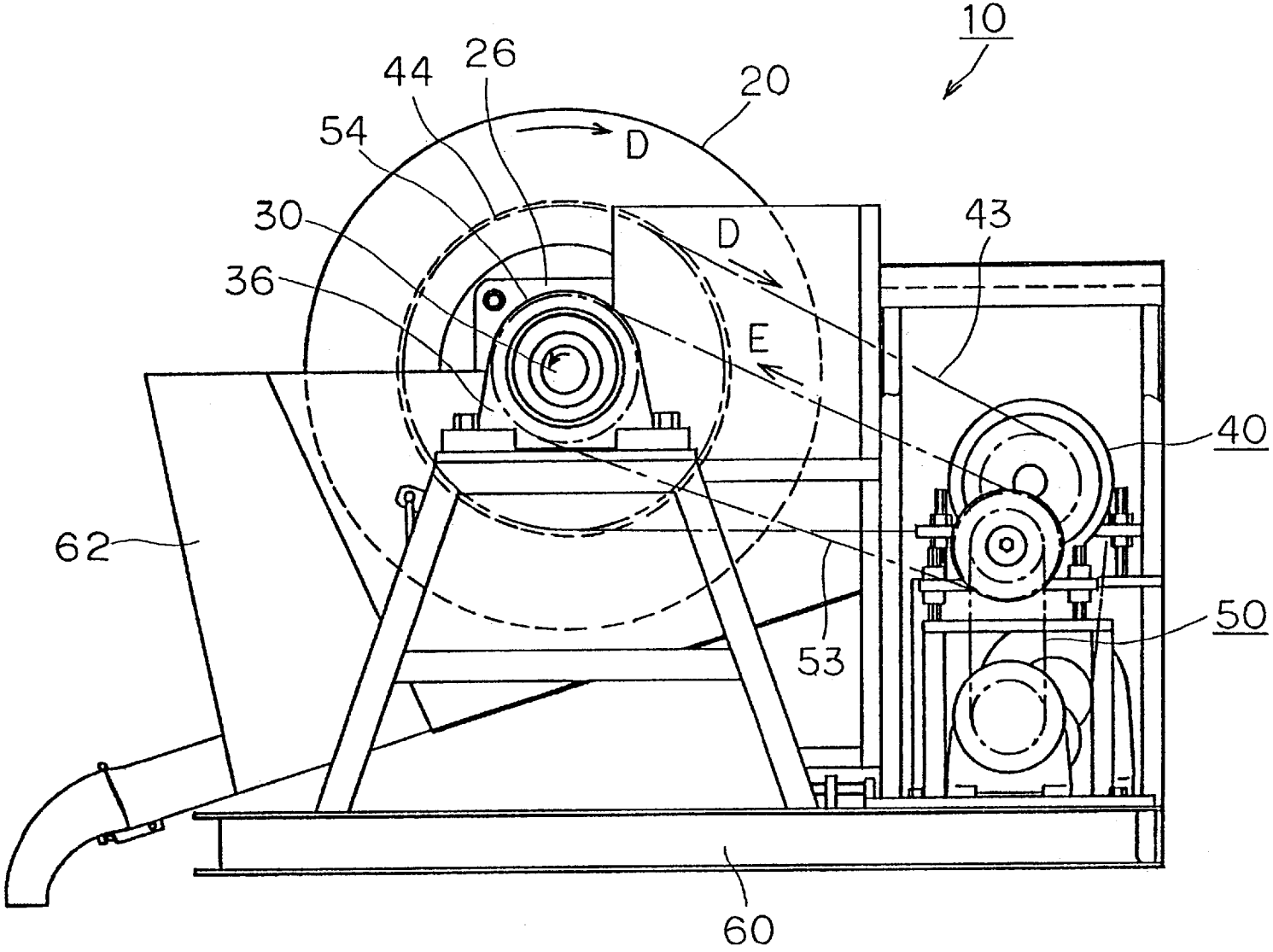
FIG. 3 is a left side view of the apparatus of FIG. 2.
Figure 4:
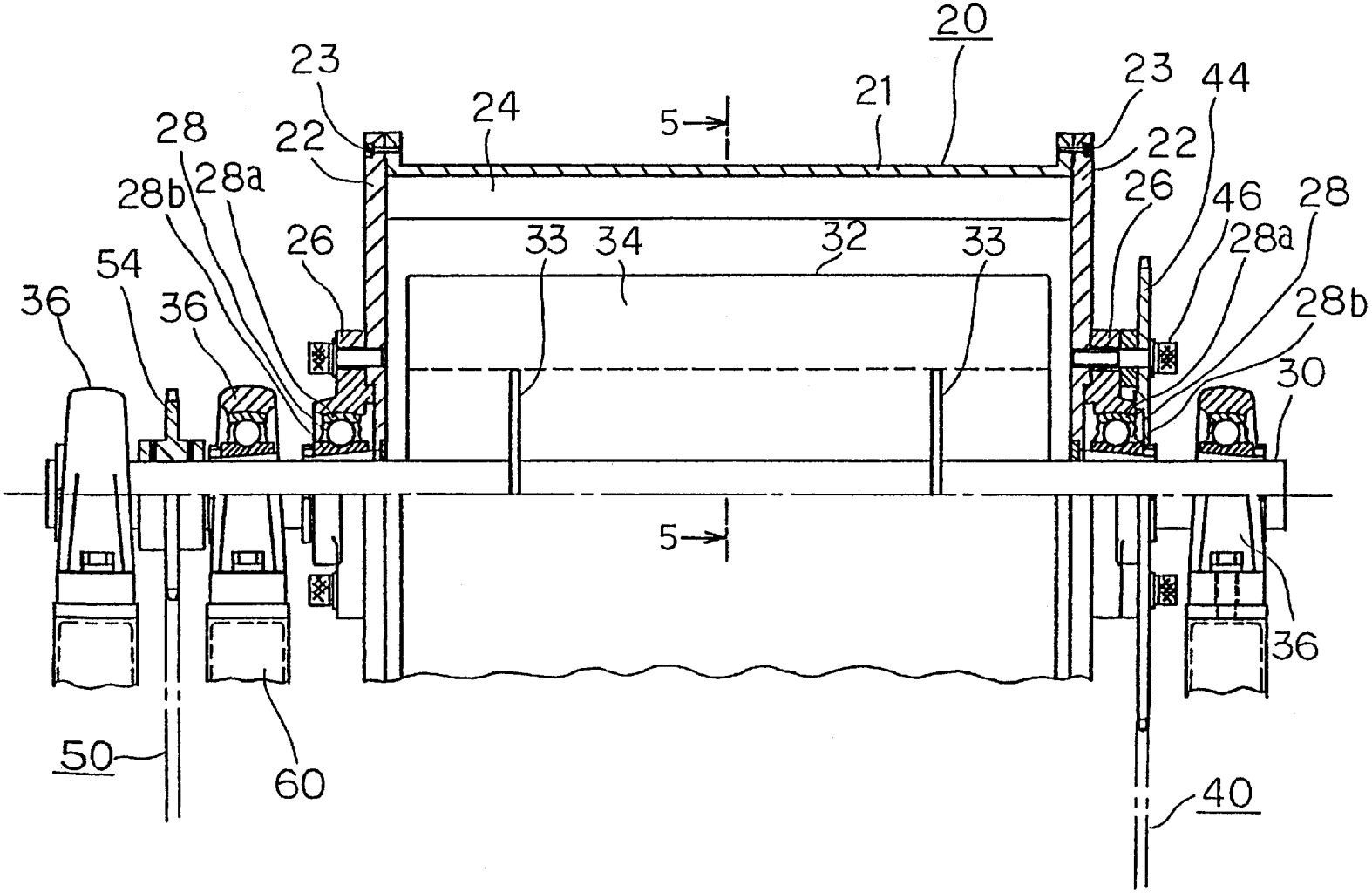
FIG. 4 is an upper half side view of the barrel of FIG. 1.
Figure 5:
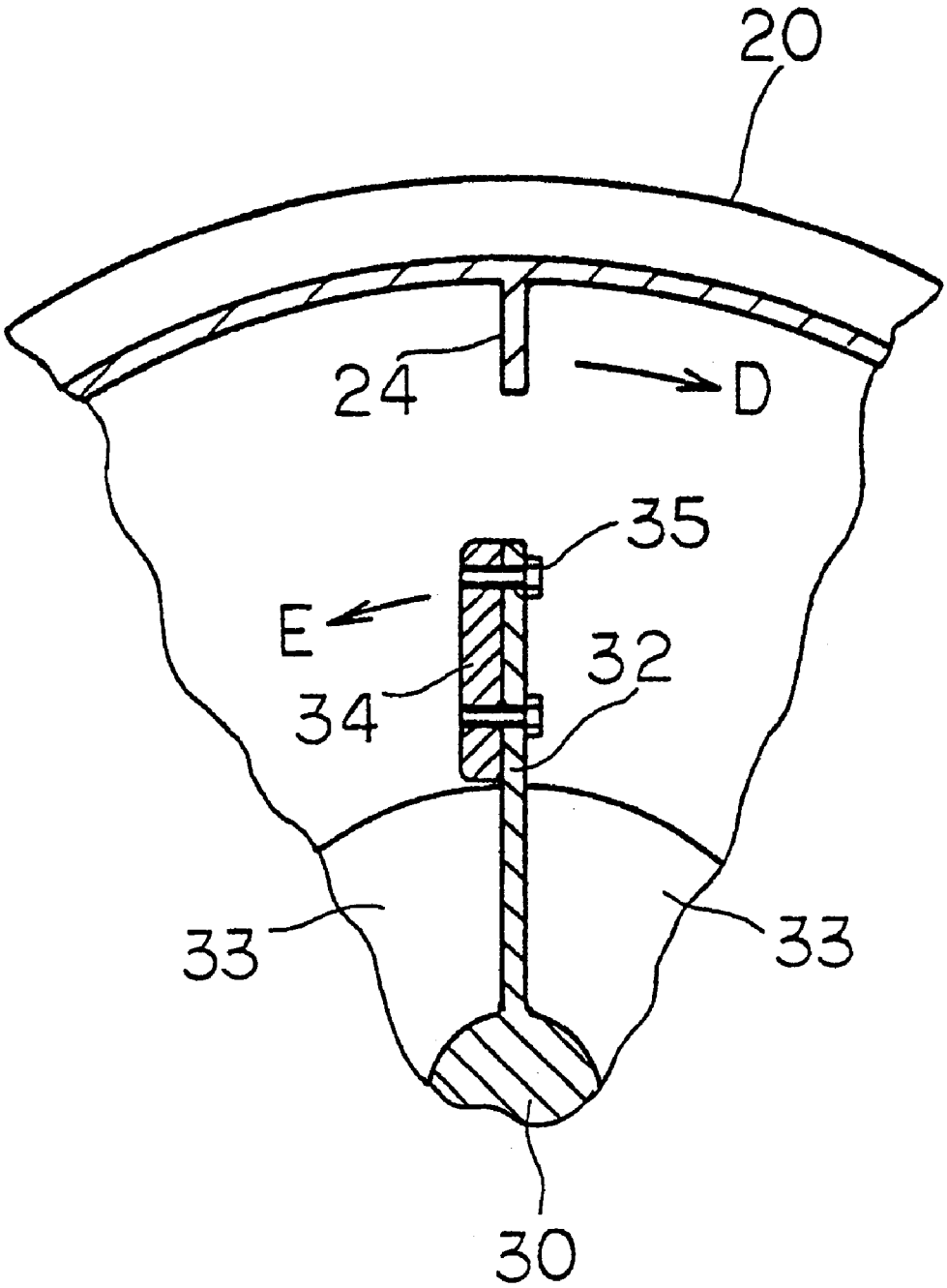
FIG. 5 is a sectional view along line 5—5 of FIG. 4.

After the surface hardening operation is completed, the steel ball charge-discharge port is opened and cylindrical barrel 20 and supporting shaft 30 are manually rotated to enable the discharge of the steel balls to a ball receiving cover 62. The ball receiving cover 62 is inclined as shown in FIG. 3 so that the steel balls roll into a holding vessel. Thereafter, the steel balls undergo a polishing process.

The respective revolution numbers (i.e., rotational speeds) of cylindrical barrel 20 and support shaft 30, and the surface-hardening treatment time are determined according to results obtained from measurements of surface layer hardness, X-ray measurements of residual compressive stress and amount of retained austenite, and rolling fatigue life tests.

Described below is a comparison of the processing conditions and parameters between the prior art illustrated in FIG. 8 and the present invention (shown in FIGS. 2–5) used to produce 5/16 inch nominal diameter steel balls with a residual compressive stress within a preferable range of 400 MPa to 800 MPa (from surface to 200 $\mu$m depth).

Figure 8:
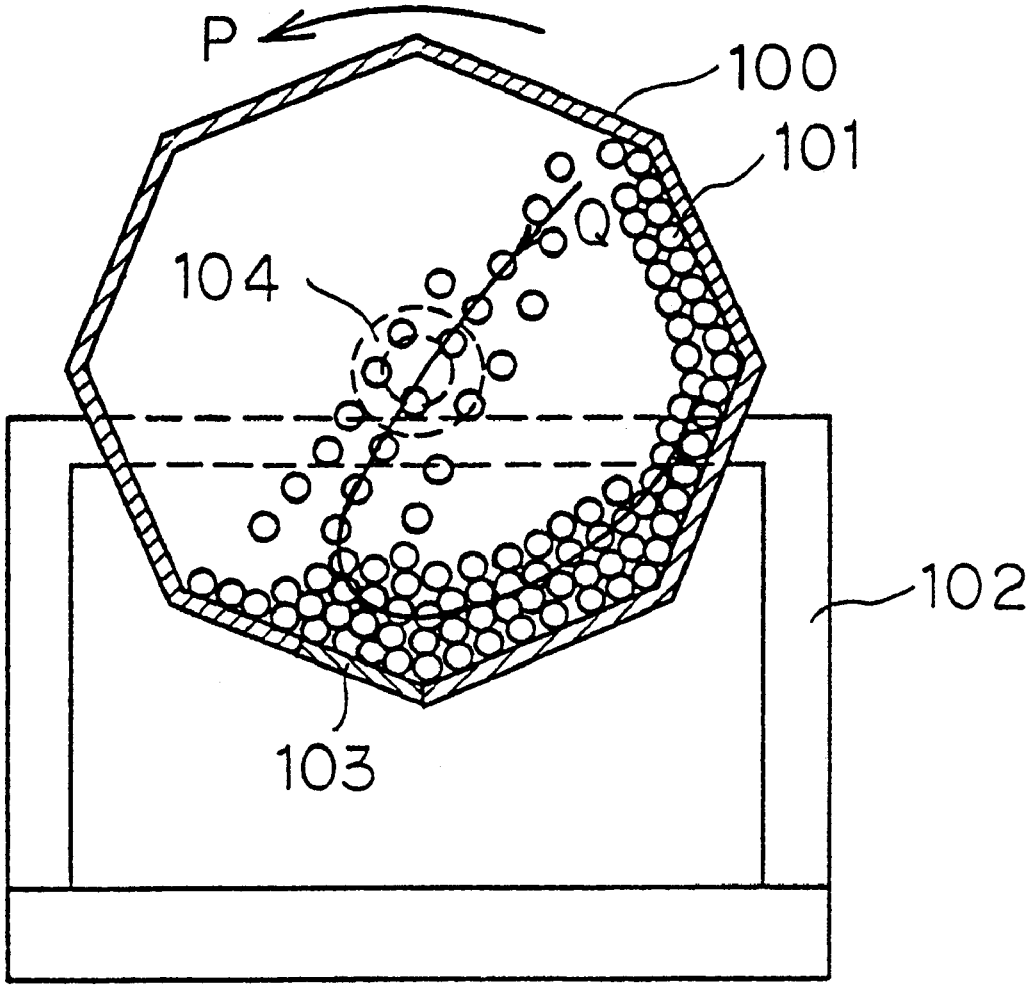
FIG. 8 is a cross sectional view of a prior art surface-hardening apparatus.

The parameters for the conventional regular octagonal steel barrel shown in FIG. 8 are:

| | |
|---|---|
| Barrel size: | 1000 mm between opposing flat sides 1200 mm in width |
| Steel ball holding capacity by weight: | 480 kgf |
| Revolution number of barrel: | 65 rpm |
| Processing time: | 2.5 hrs |

The parameters for the apparatus shown in FIGS. 2–5 are:

| | |
|---|---|
| Barrel size: | 1200 mm outside diameter; 16 mm wall thickness; 1300 mm in wide |
| Steel ball holding capacity by weight: | 480 kgf |
| Revolution number of barrel: | 20 rpm |
| Revolution number of blades: | 65 rpm |
| Processing time: | 1.5 hrs |

Thus, the processing time with the apparatus illustrated in FIGS. 2–5 is 40 percent less than that of the apparatus illustrated in FIG. 8. Thus it is shown above that the present invention can impart a specific uniform residual compressive stress and hardness to the surface layer of steel balls in a shorter period of time than by a known conventional apparatus.

In some applications, bearings (e.g. automotive transmission bearings) are required to be usable for a prolonged period of time when used in lubricating oil contaminated with foreign substances. To meet this demand, the steel balls of the bearings must have a surface layer with a higher residual compressive stress. For example, steel balls with a nominal diameter of 5/16 inch having a residual compressive stress of 1000 MPa can be produced with the apparatus (having the apparatus parameters described above) shown in FIGS. 2–5 operating under the following processing conditions:

Revolution number of barrel: 20 rpm

Revolution number of blades: 80 rpm

Processing time: 3 hrs

Figure 6:
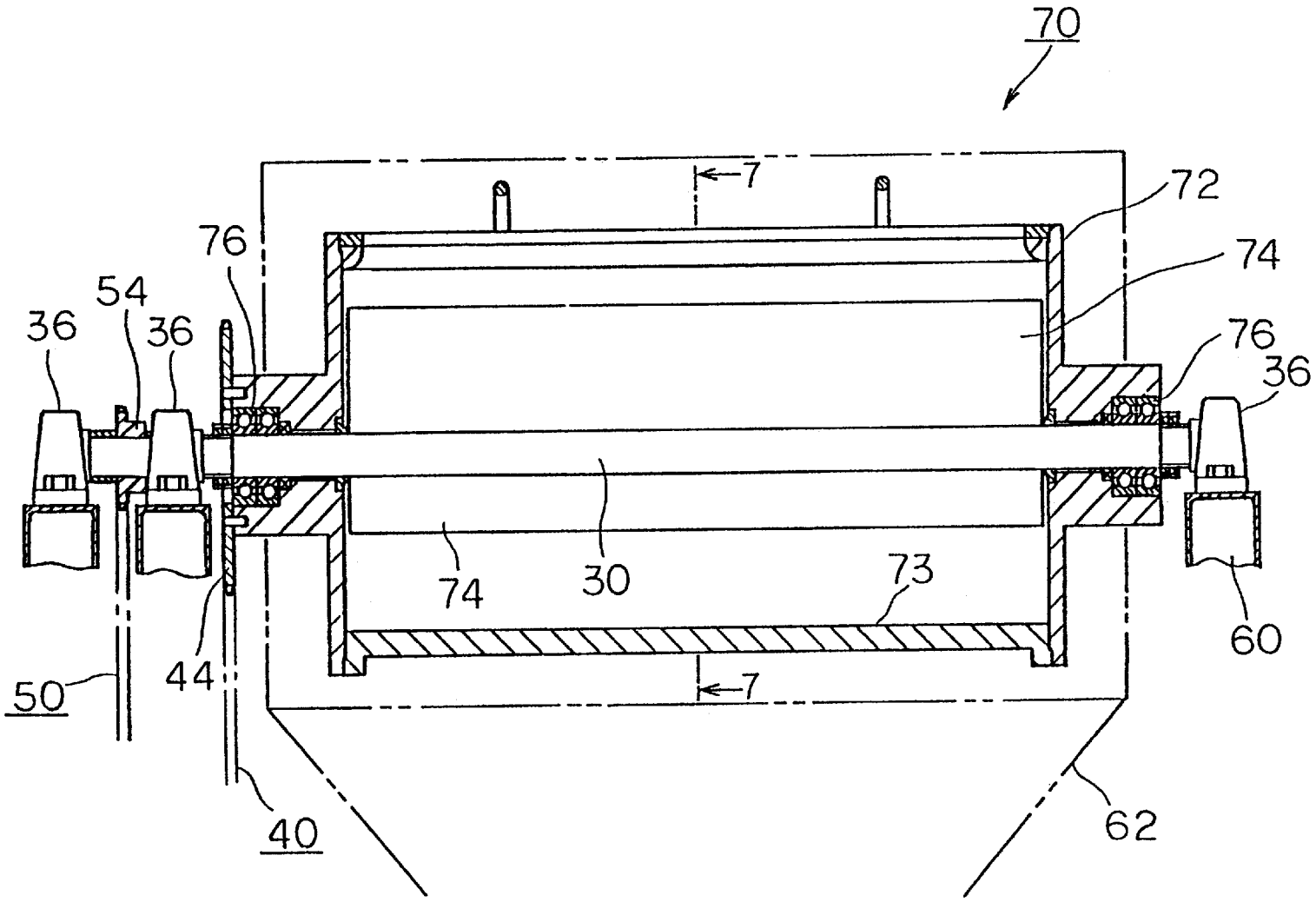
FIG. 6 is a side sectional view of a surface-hardening apparatus for 1 to 3 mm diameter steel balls.
Figure 7:
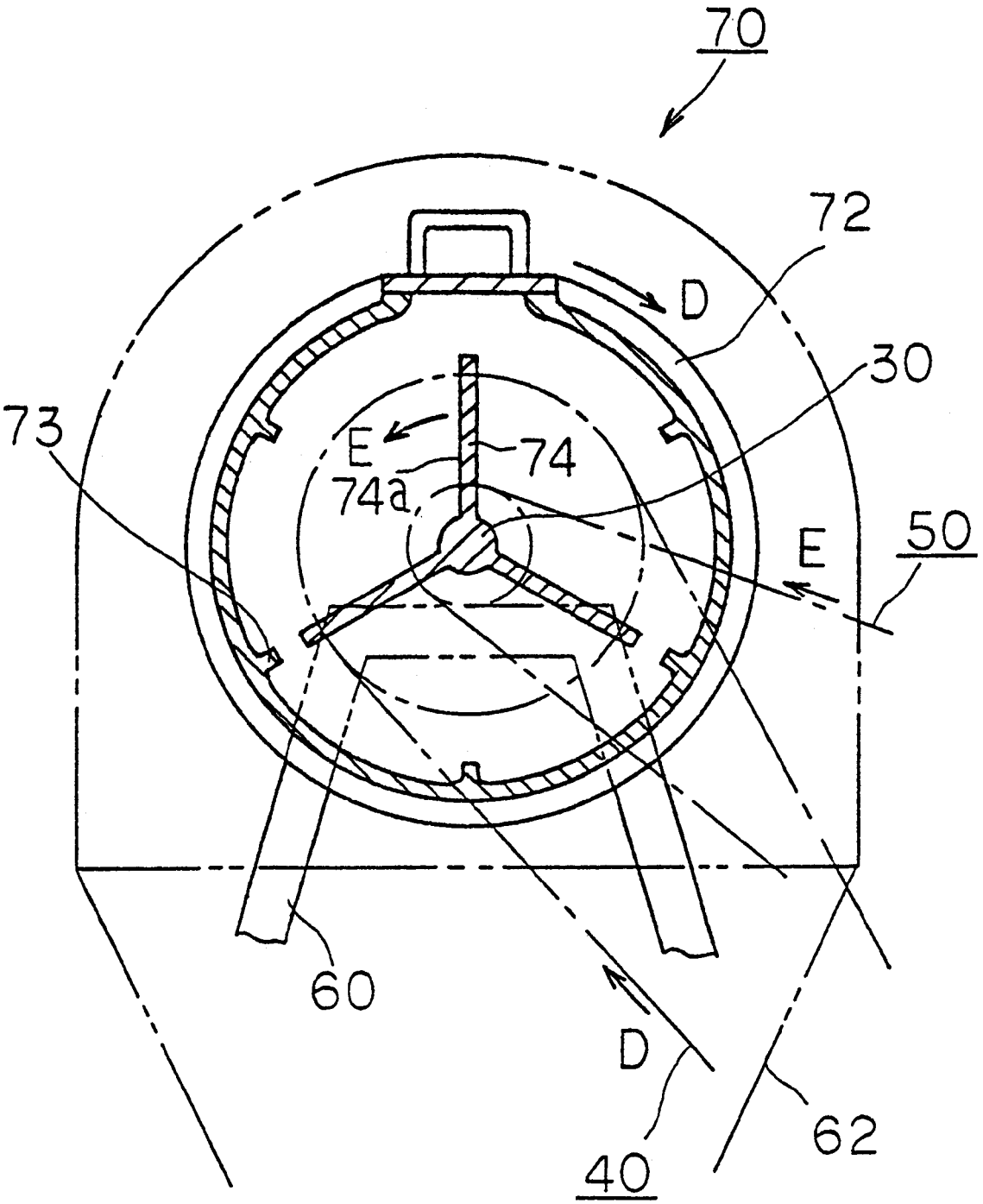
FIG. 7 is a sectional view along line 7—7 of FIG. 6.

An alternate embodiment is shown in FIGS. 6 and 7 in which a surface-hardening apparatus 70 is used to treat very small steel balls, for example, those with a diameter between 1 to 3 mm. Described below are the different characteristics of this embodiment as compared with that illustrated in FIGS. 2–5.

(1) The cylindrical barrel 72 is smaller, having an outside diameter of about 400 mm and a width of about 750 mm.

(2) There is about a 20 mm spacing between projections 73 and blades 74.

(3) A steel ball beating surface 74*a* of the blades 74 has been surface-hardened, rather than having an attached hardened beating section.

(4) Ball bearings 76 are used in place of pillow blocks .

Elements shown in FIGS. 6 and 7 similar to those shown in FIGS. 2–5 are designated by the same reference numerals and will not be described.

Small steel balls having a desired residual compressive stress are produced with the apparatus shown in FIG. 6 and 7 employing the following processing parameters:

| | |
|---|---|
| Barrel size: | 400 mm in outside diameter; 750 mm in width |
| Steel ball holding capacity by weight: | 12 kgf |
| Revolution number of barrel: | 400 rpm |
| Revolution number of blades: | 65 rpm |
| Processing time: | 4 hrs |

It is noted that the striking force on the steel balls produced by the blades can be adjusted by changing the revolution number of the blades, and thus (1) it is possible to surface-harden 1 to 3 mm diameter steel balls which have been difficult to process by heretofore known methods; and (2) it is possible to impart a residual compressive stress and hardness to the surface layer of the steel balls according to the desired use of the steel balls.

What is claimed is:

1. An apparatus for surface-hardening steel balls, comprising:

a container having first projections disposed on an inner wall of the container, said first projections protruding inwardly from and extending longitudinally along the inner wall, a support shaft having second projections disposed within said container and extending outwardly from and longitudinally along the support shaft, a container driving mechanism which rotates said container in a first direction so that, in operation, said first projections transfer said steel balls from a lower portion of the container to a higher portion where the balls are dropped to the lower portion, and a support shaft driving mechanism which rotates said support shaft in a second direction opposite to the first direction driving mechanism so that, in operation, the second projections strike the steel balls when the steel balls are dropping to the lower portion.

2. The apparatus of claim 1, wherein said container is a cylindrical barrel and said first projections protrude radially inwardly from said inner wall.

3. The apparatus of claim 1, wherein said support shaft is configured to rotate at a revolution number greater than 1.5 times that of said container.

4. The apparatus of claim 3, wherein each of said second projections has a steel ball striking region having a surface hardened by quenching.

5. The apparatus of claim 3, wherein said support shaft includes three equally spaced second projections.

6. The apparatus of claim 3, wherein said container includes six equally spaced first projections.

7. The apparatus of claim 1, wherein each of said second projections has a steel ball striking region having a surface hardened by quenching.

8. The apparatus of claim 1, wherein said support shaft includes three equally spaced second projections.

9. The apparatus of claim 1, wherein said container includes six equally spaced first projections.

10. The apparatus of claim 1, wherein said second projections are flat blades.

11. The apparatus of the claim 1 wherein each of the second projections of the support shaft include ball striking members having a surface hardened by quenching.

12. A method for surface-hardening steel balls with an apparatus including:

a container having first projections disposed on an inner wall of the container, said first projections protruding inwardly from and extending longitudinally along the inner wall, a support shaft having second projections disposed within said container and extending outwardly from and longitudinally along the support shaft, a container driving mechanism which rotates said container in a first direction so that, in operation, said first projections transfer said steel balls from a lower portion of the container to a higher portion where the balls are dropped to the lower portion, and a support shaft driving mechanism which rotates said support shaft in a second direction opposite to the first direction driving mechanism so that, in operation, the second projections strike the steel balls when the steel balls are dropping to the lower portion, the method comprising:

charging the steel balls into the container, rotating said container in said first direction, thereby moving the steel balls upwardly until the steel balls fall from the projections, rotating said support shaft in said second direction, thereby beating the falling steel balls with said second projections to cause said steel balls to strike against other steel balls and against the inner wall of said cylindrical barrel.

13. The method of claim 12, including stopping the rotation of the container and the support shaft after surface hardening of the steel balls is finished.

14. The method of claim 12, wherein said container is a cylindrical barrel and said first projections protrude radially inwardly from said inner wall.

15. The method of claim 12, wherein the step of rotating the support shaft includes rotating the support shaft at a revolution number greater than 1.5 times that of said container.

16. The method of claim 15, further comprising providing each of said second projections with a steel ball striking region having a surface hardened by quenching.

17. The method of claim 15, further comprising providing said support shaft with three equally spaced second projections.

18. The method of claim 15, further comprising providing said container with six equally spaced first projections.

19. The method of claim 12, further comprising providing said second projections with a steel ball striking region having a surface hardened by quenching.

20. The method of claim 12, further comprising providing said support shaft with three equally spaced second projections.

21. The method of claim 12, further comprising providing said container with six equally spaced first projections.

22. The method of claim 12, wherein said second projections are flat blades.

* * * * *